US008091999B2

(12) United States Patent
Fairchild et al.

(10) Patent No.: US 8,091,999 B2
(45) Date of Patent: Jan. 10, 2012

(54) MELT PLATE FOR USE IN A SOLID INK JET PRINTER

(75) Inventors: Michael Alan Fairchild, Vancouver, WA (US); James Harvey Gottsch, Tuatatin, OR (US); Ernest Isreal Esplin, Sheridan, OR (US)

(73) Assignee: Xerox Corporation, Norwalk, CT (US)

( * ) Notice: Subject to any disclaimer, the term of this patent is extended or adjusted under 35 U.S.C. 154(b) by 799 days.

(21) Appl. No.: 12/182,765

(22) Filed: Jul. 30, 2008

(65) Prior Publication Data

US 2010/0026769 A1 Feb. 4, 2010

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 5,424,767 | A | 6/1995 | Alavizadeh et al. | |
| 5,635,964 | A | 6/1997 | Burr et al. | |
| 5,784,089 | A | 7/1998 | Crawford | |
| 6,193,365 | B1 | 2/2001 | Ikezaki | |
| 6,530,655 | B2 | 3/2003 | Jones et al. | |
| 7,210,773 | B2 | 5/2007 | Jones | |
| 7,210,774 | B2 | 5/2007 | Jones | |
| 7,246,895 | B2 | 7/2007 | Jones et al. | |
| 7,611,236 | B2 * | 11/2009 | Park | 347/88 |
| 2005/0128265 | A1 * | 6/2005 | Jones | 347/88 |
| 2005/0146584 | A1 * | 7/2005 | Godil et al. | 347/88 |
| 2007/0252876 | A1 | 11/2007 | Platt et al. | |
| 2007/0268348 | A1 | 11/2007 | Jones et al. | |
| 2010/0053281 | A1 * | 3/2010 | Hindman et al. | 347/88 |
| 2010/0194834 | A1 * | 8/2010 | Jones | 347/88 |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A melt plate for use in a solid ink printer is formed with a drip plate to provide controlled flow of melted ink from the melt plate to a drip point. The melt plate includes a first portion having a perimeter, a second portion having a perimeter, the second planar portion angling from the first portion along a transition boundary at a first angle, a first rim extending around the perimeter of the first portion except along the transition boundary, the first rim angling from the first portion at a second angle, and a second rim extending around the perimeter of the second portion except along the transition boundary and a drip point, the second rim angling from the second portion at a third angle, the third angle being different than the second angle.

8 Claims, 4 Drawing Sheets

MELT PLATE FOR USE IN A SOLID INK JET PRINTER

TECHNICAL FIELD

The device and method described herein relate generally to liquid ink printers. More particularly, the device and method relate to printers that melt solid ink to produce liquid ink for use within the printer.

BACKGROUND

Some printing systems utilize solid ink that is melted to provide liquid ink. The solid ink is loaded into the printer and advanced to a melting device, which heats the solid ink to a melting temperature. The melted ink is collected and delivered to a printhead and the printhead ejects the melted ink onto media, directly or indirectly, to form an image. Typically, the melting device includes a melting surface that is warmed by a heater to melt the solid ink urged against the melting surface. The melting surface is usually vertically oriented to enable the melted ink to drain away from the melting surface/solid ink interface. A drip plate receives the melted ink and directs it to a drip point from which the liquid ink drops into a reservoir or other collection vessel for delivery to the printhead. Such a printer is described in U.S. Patent Application US2007/0268348A1 issued to Jones et al. (hereinafter 'the '348 application'), the disclosure of which is expressly incorporated herein by reference in its entirety.

Vertically orienting the melting surface constrains the placement of the drip plate. In previously known melting devices, a melting surface and drip plate structure, each of which may or may not be planar themselves, may be oriented in a non-planar manner with respect to one another. Because the ink melted by the melting surface flows under the effect of gravity from the melting surface towards the drip plate, directing and confinement of the ink flow from the melting plate to the drip point is important. Other issues for the melting device arise from solid ink, when provided in the form of solid blocks or sticks, directly impacting the melting surface when an empty loader is filled with solid ink. In gravity fed loaders, a solid ink stick may free fall against the melting surface. In spring-loaded systems, the release of the spring bias followed by the urging of a newly loaded stick against the melting surface also subjects a melting surface to some degree of impact. Consequently, the melting surface needs to be resilient and the interface between the melting surface and the drip plate needs to accommodate the melting surface/solid ink stick interaction.

SUMMARY

A melt plate for use in a solid ink printer is integrally formed with a drip plate to provide controlled flow of melted ink from the melt plate to a drip point. The melt plate includes a first portion having a perimeter, a second portion having a perimeter, the second planar portion angling from the first portion along a transition boundary at a first angle, a first rim extending around the perimeter of the first portion except along the transition boundary, the first rim angling from the first portion at a second angle, and a second rim extending around the perimeter of the second portion except along the transition boundary and a drip point.

A construction method provides the integral melt plate and drip plate with a contiguous rim that enables improved control of the liquid ink flow to a drip point. The method includes bending a metal plate to form a bend between a first portion of the metal plate and a second portion of the metal plate, and bending a portion of a perimeter of the metal plate to form a first rim around the first portion and a second rim around the second portion, the first rim and the second rim being contiguous.

An improved ink loader for a solid ink printer includes a melt plate that is formed with a drip plate to provide controlled flow of melted ink from the melt plate to a drip point. The improved ink loader includes a chute for guiding the solid ink, a melt plate for receiving the solid ink from the chute, the melt plate including: a first portion having a perimeter, a second portion having a perimeter, the second portion angling from the first portion along a transition boundary at a first angle, a first rim extending around the perimeter of the first portion except along the transition boundary, the first rim having a plurality of segments angling from the first portion, at least one segment of the first rim being at an angle that is different than at least one other segment of the first rim, and a second rim extending around the perimeter of the second portion except along the transition boundary and a drip point, the second rim having a plurality of segments with each segment angling from the second portion, at least one segment of the second rim being at an angle that is different than at least one other segment of the second rim.

BRIEF DESCRIPTION OF THE DRAWINGS

Features of the integrally formed melt plate and drip plate will become apparent to those skilled in the art from the following description with reference to the drawings.

DETAILED DESCRIPTION

The word "printer" refers, as used herein encompasses any apparatus, such as a digital copier, bookmaking machine, facsimile machine, multifunction machine, etc. which performs a print outputting function for any purpose. While the specification focuses on a melt plate that receives ink sticks from a chute and directs the ink to a reservoir, the plate may be used with any printer in which ink in any solid form is melted and delivered to a print head.

Figure 1:
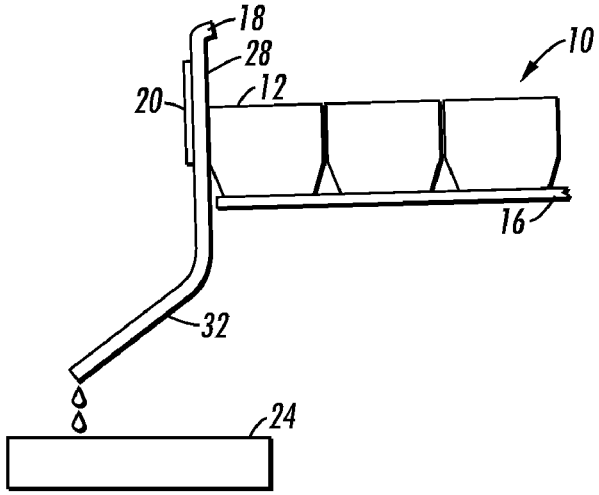
FIG. 1 is a side view of an ink loader utilizing the melt plate of the present disclosure.

FIG. 1 is a plan view of a portion of an ink loader 10 for loading solid ink sticks 12 in a printer. The sticks 12 are urged through a chute 16 by a spring-biased pusher (not shown) to a melting plate 18, which melts the sticks and conveys the melted ink to a reservoir 24. The melting plate 18 includes an upper portion 28, which operates as a melting surface, and a lower portion 32, which operates as a drip plate. One or both of the portions of the melting plate may be non-planar. A heater 20 is secured to a side of the melting plate 18 that is opposite the melting surface contacted by the ink sticks 12. Molten ink exits the melting plate in a region typically called a drip point, where ink may drip or flow. This region may appear as a point or it may have a radius or blunt appearance. Moreover, the drip point may be comprised of one or more regions in the lower portion of the melting plate. Gravity may act on the melted ink in these regions to cause the melted ink to drip or flow to a receiving opening, reservoir, or other drip target.

Figure 2:
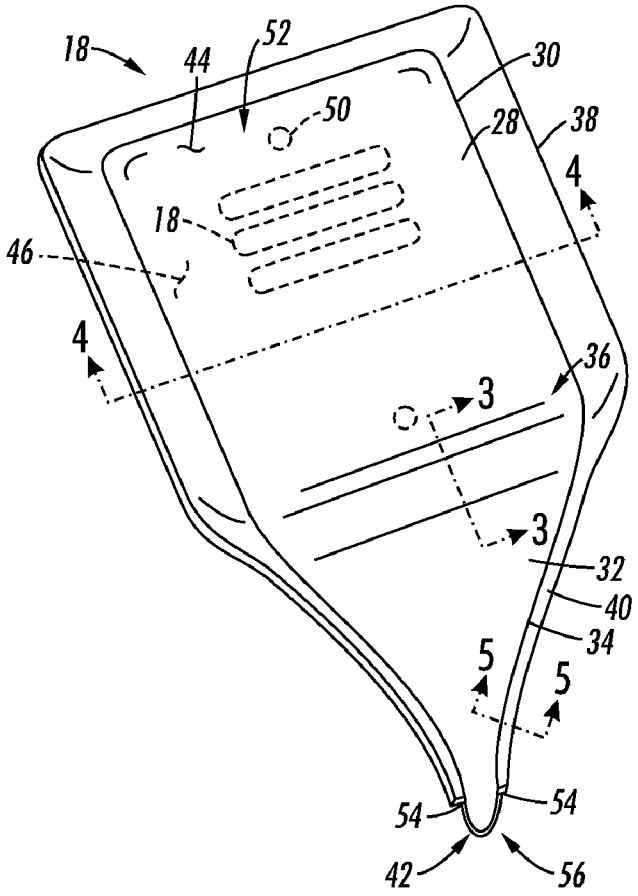
FIG. 2 is a perspective view of an illustrative melt plate for a printer.

The melting plate 18 is shown in greater detail in FIG. 2. The melting plate 18 includes a first portion 28 having a perimeter 30 and a second portion 32 having a perimeter 34. The second portion 32 angles from the first portion 28 along a transition boundary 36. A first rim 38 extends around the perimeter 30 of the first portion 28, except along the transition boundary 36. The first rim 38 angles from the first portion 28. A second rim 40 extends around the perimeter 34 of the second portion 32, except along the transition boundary 36 and at a drip point 42. The second rim 40 angles from the second portion 32 at an angle that may be different than the angle at which first rim 38 angles from first portion 28, and may, in one embodiment, be an angle that is greater than the angle at which the first rim extends from the first portion. For example, the angle at which the second rim extends from the upper surface of the second portion of the melting plate may be ninety degrees, while the first rim extends from the upper surface of the first portion at an angle of forty-five degrees. The rims 38 and 40 help prevent the melted ink from flowing over the plate 18 at locations other than the drip point 42. The drip point 42 is provided by ends 54 in the second rim 40 that define an opening 56 in the plate 18 through which melted ink on the upper surface 44 of the plate 18 exits the plate 18 to advance to the print head 24. The first portion 28 and the second portion 32 define an upper surface 44 for receiving the ink sticks 12 and a somewhat opposed lower surface 46. The plate 18 may include features for aligning and/or securing the plate to other portions of the ink loader 10.

Figure 3:
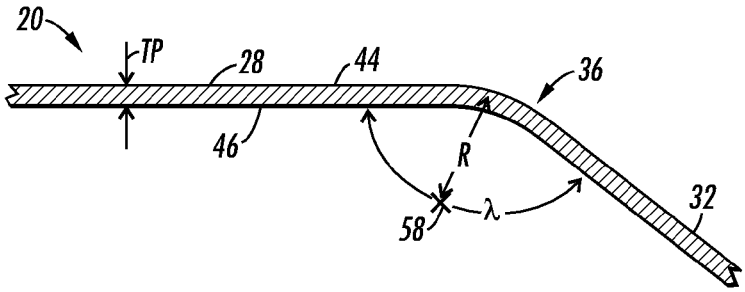
FIG. 3 is a cross sectional view of FIG. 2 along the line 3-3 in the direction of the arrows.

Referring now to FIG. 3, the angling of the second portion 32 from the first portion 28 along the transition boundary 36 is shown in greater detail. The upper surface 44 of the second portion 32 angles from the upper surface 44 of the first portion 28 along the transition boundary 36 at transition angle $\lambda$. The transition angle $\lambda$ may be any angle suitable for redirecting a flow of melted ink from the melting plate to a reservoir or other collection structure located proximate to the drip point. The transition boundary 36, for simplicity, improved strength of the plate 18, or melted ink flow considerations, may have a large arcuate cross sectional shape. For example, as shown in FIG. 3, the upper surface 44 of the plate 18 at the transition boundary 36 is defined by radius R extending from origin 58. The first portion 28 and the second portion 32 may, as shown, extend contiguously from each other. Alternatively, the first portion 28 and the second portions may be made from separate components and secured together by, for example, welding, soldering, gluing, or otherwise fastening the components together. The rims may be integral with the planar portions, as shown, or be made of separate components and secured together by a suitable method.

The plate 18 has a thickness TP that extends from upper surface 44 of the plate 18 to lower surface 46 of the plate 18. For simplicity the thickness TP is, as shown, constant or uniform for both the first portion 28 and the second portion 32, including the transition boundary 36. The plate may, however, alternatively have a varying thickness. For example, bending the plate to form the planar portions and to form the rims may result in the bent portion being thicker or thinner in the bend or in the rims. In another embodiment in which the melting plate is configured with multiple joined components, the components, such as the first and second portions and/or one or more of the rims, may be of different thicknesses.

Figure 4:
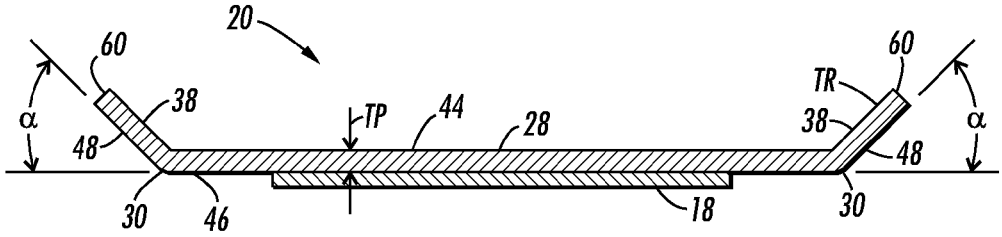
FIG. 4 is a cross sectional view of FIG. 2 along the line 4-4 in the direction of the arrows.

Referring now to FIG. 4, the angling of the first rim 38 from the perimeter 30 of the first portion 28 is shown at a first angle $\alpha$. The first angle $\alpha$ is formed between lower surface 46 of the first portion 28 and outer surface 48 of the first rim 38. The first angle $\alpha$ may be an acute angle. The first angle $\alpha$ may be, for example, forty five (45) degrees. The first rim 38 extends from perimeter 30 to edge 60 of the first rim 38. The edge 60, as shown for simplicity, may be a uniform distance from the perimeter 30 or may vary in distance to provide clearance to other components or for other reasons. The first rim 38 may, as shown, extend contiguously from the first portion 28. A radius, sharp edge or chamfer may be formed between the first rim 38 and the first portion 28.

As shown in FIG. 4, the plate 18 may further include the heater 20 in the form of an electrical heater circuit. The electrical heater circuit 20 may be provided in any suitable fashion and may, as shown, be printed onto the lower surface 46 of the plate 18. The circuit may be applied to the melting plate by any suitable process, including a printing method, such as silk screening, or it may be, alternatively, sputtered onto the surface. The heater circuit 20 may, alternatively, include a foil heater encapsulated within a thin electrically insulative material, such as, for example, Kapton film, which may be bonded to the upper surface 44 and/or the lower surface 46. Silicone heaters may alternatively be secured to the plate 18. Another example of a heater that may be used is a moldable PTC material, which may also form one or more portions, including all, of the melting plate. Heater circuits may be placed on the sides facing the ink being melted and/or on the opposite side of the melting plate.

Figure 5:
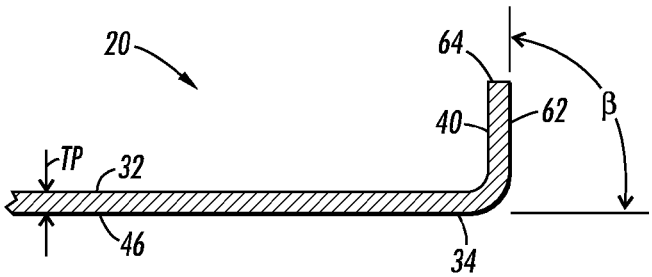
FIG. 5 is a cross sectional view of FIG. 2 along the line 5-5 in the direction of the arrows.

Referring now to FIG. 5, the angling of the second rim 40 from the perimeter 34 of the second portion 32 is shown at a second angle $\beta$. The second angle $\beta$ is formed between lower surface 46 of the second portion 32 and outer surface 62 of the second rim 40. The second angle $\beta$ may be different than the first angle. For example, the second angle $\beta$ may be twice the first angle $\alpha$. The second angle $\beta$ may be an obtuse angle, or an acute angle, up to and including a right angle. The second angle $\beta$ may be, for example, ninety (90) degrees. The second rim 40 extends from perimeter 34 to edge 64 of the second rim 40. The edge 64, as shown for simplicity, may be a uniform distance from the perimeter 32 or may vary in distance to provide clearance to other components or for other reasons. The first rim 38 and the second rim 40 may, for simplicity, have a thickness TR that is generally the same as the thickness TP of the planar portions 28 and 32. The second rim 40 may, as shown, extend contiguously from the second portion 32. A radius, a sharp edge, or chamfer may be formed between the second rim 40 and the second portion 32. Further, the second rim 40 may, as shown, extend contiguously from the first rim 38. Alternatively, the first rim 38 and the second rim 40 may be separate components that are closely proximate, touching, or joined together by suitable methods.

The melting plate need not be symmetrical in shape from side to side of the plate. For example, the first and the second portions may have different surface configurations and dimensions on different sides of a vertical line extending from the drip point to the top of the first portion. The different configurations from side to side of the melting plate include the rims as well. Additionally, one or both of the portions may be non-planar. For example, a recess may be formed in the first portion to facilitate molten ink flow. Other topographical configurations may be used to increase surface area for more rapid melting. In another example, the second portion may be fully or partially curved for flow control or to accommodate offsets between an ink loader and a drip target. Such surfaces may also be implemented with multiple angled sections or a segmented second portion.

The plate 18 may be made by any suitable, durable material such as a metal, a ceramic, a polymer, or a composite material. If the heater is secured to the lower surface of the plate 18, the plate 18 may be made of a material with sufficient thermal conductivity, such as metal, to spread heat for efficiently melting ink sticks. The plate may be made of a non-ferrous metal such as, for example, aluminum, brass, or copper. These materials are suitable because they allow greater flexibility in physical characteristics of the drip plate. In addition, these metals conduct heat better, which is helpful when the heating mechanism is on the other side of the drip plate from the ink stick. For example, the plate 18 may be made of aluminum. For simplicity and as shown, the plate 18 is integral. The plate may likewise be fabricated of multiple components and joined together by welding, soldering, gluing or by otherwise fastening the components together.

The plate 18 may be made by any suitable fabrication technique. For example, if the plate is made of a polymer, the plate may be injection molded or vacuum molded, or made by some other suitable technique. If the plate is made of a metal, such as aluminum, the plate may be cast, forged, machined from metal stock, formed, or fabricated by other suitable technique. For example, the plate may made by bending a metal plate. The plate may be bent in a forming tool or in a press.

One or more plates 18 of the present disclosure may be used in a monochromic printer utilizing, for example only black ink sticks. Alternatively, a plurality of similar plates may be used in a multicolor printer, one plate for each different color stick. For example, the printer may be a full color printer and use four separate channels, or chutes, with a melting plate and a print head corresponding to each chute. The four chutes may accommodate, black, yellow, magenta, and cyan sticks. The plates of each ink feed channel may be identical or may be configured differently. For example, plates at the ends of two of the channels may be configured with symmetrical structure having a drip point offset from the center of the plates.

Figure 6:
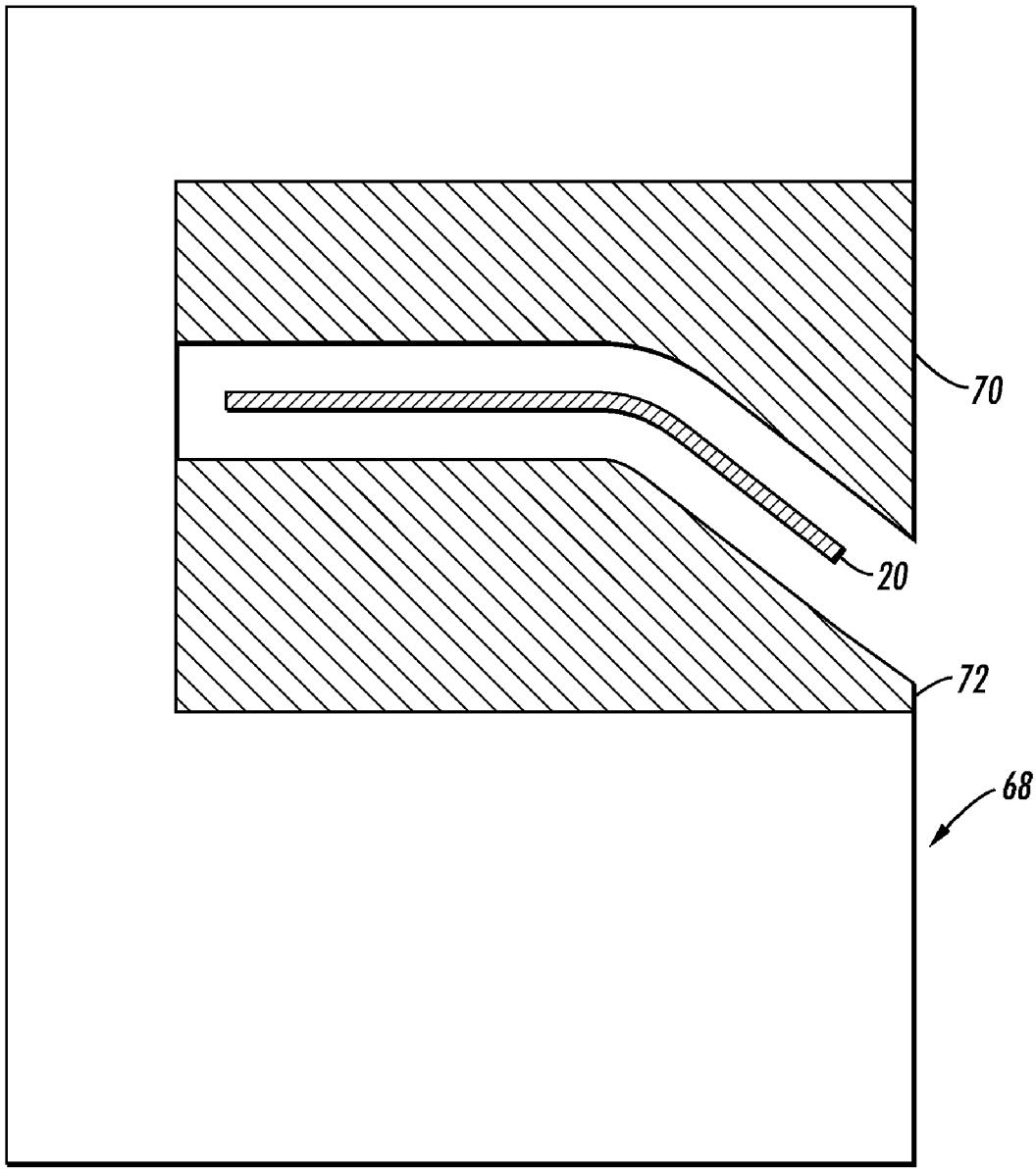
FIG. 6 is a plan view of a press for use in fabricating the plate of the present disclosure.

Referring now to FIG. 6, a press type forming tool 68 is shown for fabricating the plate 18. The press 68 includes an upper die 70 having a shape complementary to the entire upper side of the plate including the planar portions and the rims and a lower die 72 having a shape complementary to the entire lower side of the plate including the planar portions and the rims. A sheet of metal is placed between the dies 70 and 72. The dies 70 and 72 are advanced together to form the sheet into the plate 18 including the rims 38 and 40. The dies 70 and 72 are then separated to permit removal of the formed plate 18. The heater 20 may be applied onto the flat sheet of metal prior to being placed in the press 68 or may be applied later. The plate 18 may have its final shape including the rims 38 and 40 when removed from the press 68.

Alternatively, the plate may be formed by a multiple step process in which the plate is partially formed in one or more initial steps with initial forming dies (not shown) and then finished in one or more subsequent steps with finishing dies (not shown). As an example, first, the roughing dies are installed in the press and the flat plate is placed in the press between the dies. The roughing dies may have two planar portions and a curved portion. The roughing dies are advanced toward each other causing the flat plate to form the transition boundary 36 and to angle the first or upper planar portion 28 relative to the second or lower planar portion 32 to produce a partially processed plate. Secondly, the finishing dies are installed in the press 68, or another forming station, and the partially processed plate is placed in the press between the dies. The finishing dies have shapes that are complementary to the final shape of the plate 18 including the planar portions and the rims. The finishing dies are advanced toward each other forming the first rim 38 and the second rim 40 onto the partially processed plate to fabricate the final shape of the plate 18.

Figure 7:
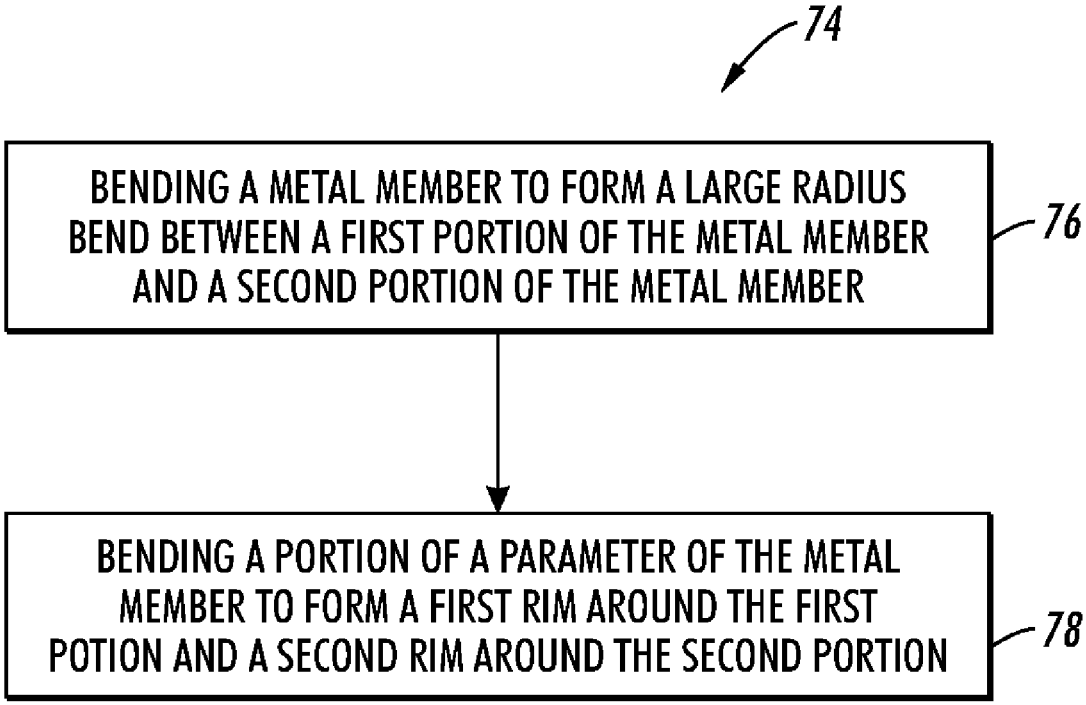
FIG. 7 is a flow diagram of a process for fabricating a melt plate according to the present disclosure.

Referring now to FIG. 7, a method 74 of constructing a melt plate for use in a solid ink printer is shown. The method 74 includes bending a metal member to form a large radius bend between a first portion of the metal member and a second portion of the metal member (block 76). A portion of a perimeter of the bent metal member is then bent to form a first rim around the first portion and a second rim around the second portion (block 78). The second rim, in this example, is formed so it angles from the second portion at an angle that is approximately twice an angle at which the first rim angles from the first portion.

The formation of the bend may angle the second portion from the first portion by any suitable angle. The choice of bend angles, radii, and plate surface configurations are influenced by the implementation parameters of the product in which the melting plate is to be installed. For example, the angle at which an ink stick is delivered by the ink loader to the melting plate, the flow behavior or viscosity of the melted material, surface tension of molten ink on the plate material, orientation of components with respect to gravitational forces, and the dimensions required for the plate to deliver melted ink to the drip target, may influence one or more of the surface configurations, and spatial relationships of the portions forming the melting plate. In one embodiment, the ink loader may be uniformly or partially offset from the drip targets and require asymmetrically shaped melting plates and/or portions of the melting plate to be angled in multiple axes relative to the ink feed path.

It will be appreciated that various of the above-disclosed and other features and functions, or alternatives thereof, may be desirably combined into may other different systems or applications. Various presently unforeseen or unanticipated alternatives, modifications, variations, or improvements therein may be subsequently made by those skilled in the art which are also intended to be encompassed by the following claims.

We claim:

1. An ink loader for use loading solid ink into a phase change ink jet printer, comprising:

a chute for guiding the solid ink;

a melt plate for receiving the solid ink from the chute, the melt plate including:

a first portion having a perimeter;

a second portion having a perimeter, the second portion angling from the first portion along a transition boundary at a first angle;

a first rim extending around the perimeter of the first portion except along the transition boundary, the first rim having a plurality of segments with each segment angling from the first portion, at least one segment being at an angle that is different than at least one other segment of the first rim; and a second rim extending around the perimeter of the second portion except along the transition boundary and a drip point, the second rim having a plurality of segments with each segment angling from the second portion, at least one segment being at an angle that is different than at least one other segment of the second rim.

2. The ink loader of claim 1 wherein the first portion and the second portion are formed contiguously from a single sheet member.

3. The ink loader of claim 1 wherein the first rim is contiguous with the second rim.

4. The ink loader of claim 1 wherein at least one segment of the first portion has a length that is different from at least one segment of the second portion.

5. The ink loader of claim 1 further comprising:

an electrical heater circuit applied on a surface of the first portion.

6. The ink loader of claim 1 wherein at least one of the first portion and the second portion are asymmetrically bent from one side to another side.

7. The melt plate of claim 1 wherein the second portion forms a drip plate that is configured to receive the melted ink across the transition boundary and direct the melted ink to the drip point.

8. The melt plate of claim 1 wherein at least one of the first portion and the second portion are non-planar in at least a portion of an area inside the corresponding rim.

* * * * *